US010111796B2

(12) United States Patent
Wakabayashi et al.

(10) Patent No.: US 10,111,796 B2
(45) Date of Patent: Oct. 30, 2018

(54) INCUBATOR

(71) Applicant: ATOM MEDICAL CORPORATION, Bunkyo-ku, Tokyo (JP)

(72) Inventors: Keisuke Wakabayashi, Saitama (JP); Kenji Kobayashi, Saitama (JP); Masaaki Oohashi, Saitama (JP); Ichiro Matsubara, Tokyo (JP); Terumi Matsubara, Tokyo (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 116 days.

(21) Appl. No.: 15/398,152

(22) Filed: Jan. 4, 2017

(65) Prior Publication Data

US 2017/0196747 A1 Jul. 13, 2017

(30) Foreign Application Priority Data

Jan. 12, 2016 (JP) ..... 2016-003344

(51) Int. Cl.
*A61G 11/00* (2006.01)

(52) U.S. Cl.
CPC ..... *A61G 11/006* (2013.01); *A61G 11/009* (2013.01)

(58) Field of Classification Search
CPC ..... A61G 1/00; A61G 11/009
USPC ..... 600/21–22
See application file for complete search history.

(56) References Cited

U.S. PATENT DOCUMENTS 5,112,293 A * 5/1992 Vaccaro ..... A61G 11/00 128/205.26
5,129,879 A * 7/1992 Mattson ..... A61G 11/00 292/DIG. 56
2010/0109347 A1* 5/2010 Matsubara ..... A61G 11/00 292/121

FOREIGN PATENT DOCUMENTS

JP 2012-085908 A 5/2012

* cited by examiner

*Primary Examiner* — John Lacyk
(74) *Attorney, Agent, or Firm* — Brinks Gilson & Lione

(57) ABSTRACT

The present invention provides an incubator in which there is no particular need to interpose annular shaped packing, which is capable of substantially maintaining airtightness between a base frame positioned in the vicinity of an outer periphery of a service port and a service door, between the vicinity of the outer periphery of the service port and the service door. The incubator includes a substantially ring-shaped insertion groove that is formed in an inner face of the service door so as to substantially run along an outer periphery of the inner face, and a substantially ring-shaped outer peripheral portion that is formed to the base frame, and is configured such that a substantially ring-shaped leading end of the substantially ring-shaped outer peripheral portion can be inserted in a substantially ring shape into the substantially ring-shaped insertion groove.

10 Claims, 9 Drawing Sheets

INCUBATOR

RELATED APPLICATIONS

This application claims priority under 35 U.S.C. § 119 to Japanese Patent Application No. 2016-003344 filed on Jan. 12, 2016, the entire content of which is hereby incorporated by reference.

BACKGROUND OF THE INVENTION

1. Field of the Invention

Preferred embodiments relate to an incubator including a service port provided in a peripheral wall section of an infant accommodation space, a service door capable of opening and closing the service port by swinging to and fro, a base frame that is attached to the peripheral wall section in order to retain the service door so as to swing to and fro, and a latch mechanism that is capable of retaining the service door in a closed position.

2. Description of the Related Art

As is substantially described in Japanese Patent Application Laid-Open (JP-A) No. 2012-85908, incubators configured such as that described above are conventionally known. The incubator described in the above publication includes a service port provided in a peripheral wall section of an infant accommodation space of the incubator, a service door capable of opening and closing the service port by swinging to and fro, a base frame that is attached to the peripheral wall section in order to retain the service door so as to swing to and fro, and a latch mechanism that is capable of retaining the service door in a closed position. The latch mechanism includes a latch lever, which swings between a retaining position to perform the retaining and a release position to release the retaining, in the vicinity of the peripheral wall section of the infant accommodation space, and an operating lever that swings'the latch lever to the release position by swinging about an axial center that is the same as, or parallel to, an axial center of a support shaft of the latch lever. Thus, in this incubator, the service port can be easily opened by swinging the service door with using a region other than fingers (such as their elbow) of a user, while there is little concern of a change in the physical condition of an infant such as a newborn infant due to such an operation.

However, in the above-described incubator, an annular shaped packing made of silicone rubber is interposed between the base frame positioned in the vicinity of an outer periphery of the service port and the service door in order to substantially maintain airtightness between the vicinity of the outer periphery of the service port and the service door. Specifically, the annular shaped silicone rubber packing is attached to the base frame. Thus, the annular shaped silicone rubber packing needs to be detached from the base frame and cleaned by soaking in antiseptic when the annular shaped silicone rubber packing has been soiled by bodily fluid of the infant, for example, such that a lengthy soaking and sterilization operation needs to be performed. There is also a concern that the airtight function of the infant accommodation space of the incubator might be reduced, since the packing is not replaced by users in a hospital, for example, even when the annular shaped silicone rubber packing deteriorates over time. The silicone rubber packing has as an issue of the high cost of the packing.

SUMMARY OF THE INVENTION

The preferred embodiments effectively resolve the above-described issues relating to the incubator in the above publication using a comparatively simple configuration.

A first aspect of present disclosure is to provide an incubator including a service port that is provided at a peripheral wall section of an infant accommodation space, a service door that is capable of opening and closing the service port by swinging to and fro, a base frame that is attached to the peripheral wall section and retains the service door so as to be capable of swinging to and fro, a latch mechanism that retains the service door in a closed position. A substantially ring-shaped insertion groove is formed at an inner face of the service door so as to run along an outer periphery of the inner face, and a substantially ring-shaped outer peripheral portion is formed at the base frame. The incubator is configured such that, when the service door is retained in the closed position, a leading end of the substantially ring-shaped outer peripheral portion of the base frame is inserted into the substantially ring-shaped insertion groove of the service door. Due to being configured in this manner, there is no particular need to interpose annular shaped packing, which is made of silicone rubber or the like, between the base frame positioned in the vicinity of the outer periphery of the service port and the service door such that the packing maintains airtightness between the vicinity of the outer periphery of the service port and the service door,. Thus, there is no need to detach the annular shaped packing from the base frame to be cleaned by lengthy soaking and sterilization in antiseptic when the packing has been soiled by bodily fluid of an infant, for example. Thus, there is no concern that the airtight function and so on of the infant accommodation space of the incubator might be reduced, as the annular shaped packing deteriorates over time due to not being cleaned by users in a hospital or the like. Moreover, there is no need to use annular shaped packing made of silicone rubber or the like such as that described above, which has a comparatively high cost, thereby reducing the manufacturing cost of the incubator and the usage cost of the incubator.

In a structure of a second aspect of the present disclosure: a thickness of the substantially ring-shaped outer peripheral portion of the base frame is from 1.5 mm to 6.1 mm (is more preferably from 2.3 mm to 5.3 mm, and is most preferably from 3 mm to 4.6 mm); a width of a flat central portion of the leading end of the substantially ring-shaped outer peripheral portion is from 0.32 mm to 1.28 mm (is more preferably from 0.48 mm to 1.12 mm, and is most preferably from 0.64 mm to 0.96 mm); a radius of a circular arc face on both left and right sides of the flat central portion of the leading end is from 0.6 mm to 2.4 mm (is more preferably from 0.9 mm to 2.1 mm, and is most preferably from 1.2 mm to 1.8 mm); a width of the substantially ring-shaped insertion groove of the service door is from 2.5 mm to 10 mm (is more preferably from 3.8 mm to 8.8 mm, and is most preferably from 5 mm to 7.6 mm); a radius of a circular arc-shaped sloping face in a width direction of the substantially ring-shaped insertion groove is from 1.6 mm to 6.4 mm (is more preferably from 2.4 mm to 5.6 mm, and is most preferably from 3.2 mm to 4.8 mm); and a ratio of the thickness of the substantially ring-shaped outer peripheral portion to the width of the substantially ring-shaped insertion groove is from 0.24:1 to 0.96:1 (is more preferably from 0.36:1 to 0.84:1, and is most preferably from 0.48:1 to 0.72:1). Due to being configured in this manner, the leading end of the outer peripheral portion of the base frame is simply inserted into the ring-shaped insertion groove rather than being fitted together with the ring-shaped insertion groove, such that there is little concern of the ring-shaped insertion groove or the ring-shaped leading end being damaged by this insertion.

In a structure of a third aspect of the present disclosure, an inner face of the substantially ring-shaped outer peripheral portion of the base frame slopes with a taper such that a region inside the ring-shaped outer peripheral portion decreases on progression from the infant accommodation space side toward an exterior space side. Due to being configured in this manner, even when liquid droplets such as water droplets have been deposited at the inner face in the vicinity of the lower side of the outer peripheral portion formed at the base frame, such liquid droplets mainly flow toward the infant accommodation space, and there is little concern of the liquid droplets flowing out into the exterior. In a first mode of the third aspect of the present disclosure, an angle of slope of the taper is from 2° to 8° (is more preferably from 3° to 7°, and is most preferably from 4° to 6°). Due to being configured in this manner, the above-described advantageous effects exhibited in the third aspect can be even more favorably exhibited.

In a structure of fourth aspect of the present disclosure, the base frame is configured by a plastic material. Due to being configured in this manner, even if the inner face of the base frame attached to the peripheral wall section of the infant accommodation space becomes somewhat soiled due to the liquid droplets or the like, this soiling can be easily removed and cleaning is easily performed. In a fifth aspect of the present disclosure, the incubator is a closed incubator. In this configuration, the incubator is a closed incubator, thereby enabling an incubator to be provided in which external air is not liable to enter inside the infant accommodation space.

Other objects, characteristics, and advantages of the present disclosure as described above should become clear simply by reading the following detailed description in relation to the attached drawings.

BRIEF DESCRIPTION OF THE DRAWINGS

Preferred embodiments will be described in detail based on the following figures, wherein.

DETAILED DESCRIPTION OF THE PREFERRED EMBODIMENTS

Explanation follows regarding an exemplary embodiment in which the present disclosure is applied to a closed incubator, with reference to FIG. 1 to FIG. 8, under the headings: "1. Brief Explanation of Overall Incubator" and "2. Explanation of Service Door Mechanism".

1. Brief Explanation of Overall Incubator

Figure 1:
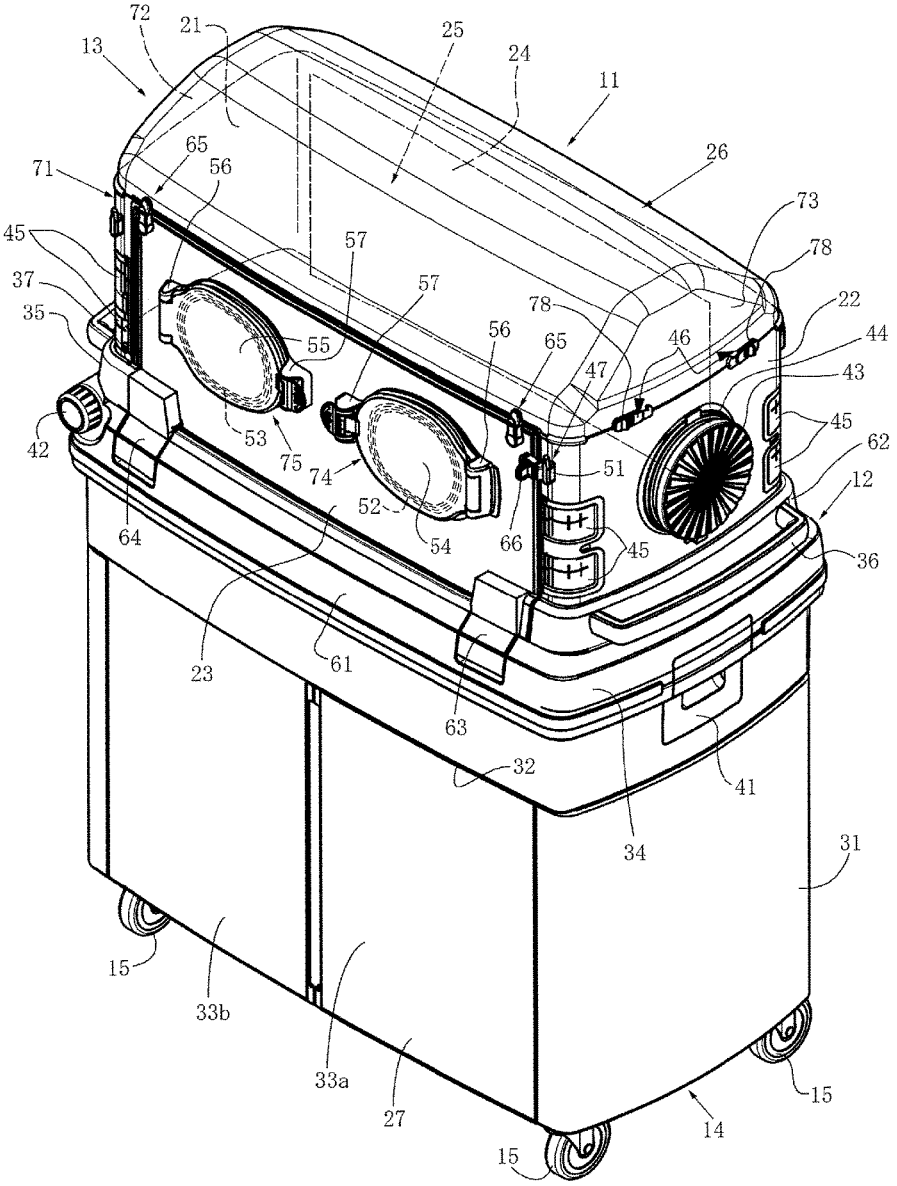
FIG. 1 is a perspective view of an incubator of an exemplary embodiment in which the present disclosure is applied to a closed incubator.

As illustrated in FIG. 1, a closed incubator 11 respectively includes an incubator base 12 with a substantially rectangular shape, in other words, a substantially cuboid shape or the like, in plan view, an enclosure 13 standing above the incubator base 12 in a substantially cuboid shape or the like about an outer periphery of the incubator base 12, and a trolley 14 serving as an incubator base support means or an incubator base support mechanism with the incubator base 12 attached and fixed to an upper face of the trolley 14. The enclosure 13 is attached and fixed onto the incubator base 12 so as to be both easily attached thereto and detached therefrom. Wheels 15 used to move the incubator 11 are respectively attached to and supported by the four corners on a lower face of the trolley 14. Note that, as required, the incubator base 12 may be attached and fixed to the trolley 14 so as to be both easily attached thereto and detached therefrom, or may be attached and fixed to the trolley 14 so as to be incapable of being easily detached after having been attached. For example, the incubator base 12 may be attached and fixed to the trolley 14 so as enable comparatively easy detachment therefrom using a coupling tool (not illustrated in the drawings) formed of nuts and bolts.

As illustrated in FIG. 1, the enclosure 13 respectively includes: a head side peripheral wall section 21 configuring a wall section on a head side of an infant accommodated in the enclosure 13 and serving as a first fixed side peripheral wall section; a leg side peripheral wall section 22, configuring a wall section on the leg side of the infant and serving as a second fixed side peripheral wall section; a front side peripheral wall section 23 serving as a first movable side peripheral wall section; a rear side peripheral wall section 24 serving as a second movable side peripheral wall section; and a top hood 26 installed so as to cover the entire upper face of an infant accommodation space 25 surrounded by the peripheral wall sections 21 to 24. Note that the entire enclosure 13 may be transparent, or may be semi-transparent, or the like. The peripheral wall sections 21 to 24 and the top hood 26 may each be configured from a material such as a thermoplastic synthetic resin, such as a transparent or semi-transparent polycarbonate resin or acrylic resin, or another synthetic resin.

The trolley 14 illustrated in FIG. 1 may be entirely made of a metal such as steel, and may have a substantially boxlike shape such as a cuboid shape. The trolley 14 respectively includes a trolley body 31 including an opening 32 formed so as to open the entire area of at least one side face, such as a front side face 27, and a left and right pair of opening-closing doors 33*a*, 33*b* that are respectively attached to the trolley body 31 so as to be capable of swinging in order to open and close the opening 32 of the trolley body 31. Note that the left and right pair of opening-closing doors 33*a*, 33*b* are attached to the trolley body 31 so as to be swingable to and fro about respective swing pivot points in the vicinity of left side and right side ends on the front side of the trolley body 31.

As illustrated in FIG. 1, a left side handle 36 and a right side handle 37 are respectively fixed to outer faces in the vicinity of upper portions of a left side wall 34 and a right side wall 35 of the incubator base 12. The left side and right side handles 36, 37 may each be formed in a substantially U-shape, or the like. Both ends of the respective handles 36, 37 may be attached and fixed, or integrally molded, to the respective left side wall 34 and right side wall 35. A humidifier 41 is mounted so as to be detachably attached to a left side face of the incubator base 12. The humidifier 41 is removable from the incubator base 12 by being pulled out therefrom. An angle adjustment knob 42 is installed on a right side face of the incubator base 12 so as to adjust a tilt angle from a head side portion to a leg side portion of a mattress tray (not illustrated in the drawings) installed inside the enclosure 13.

Figure 2:
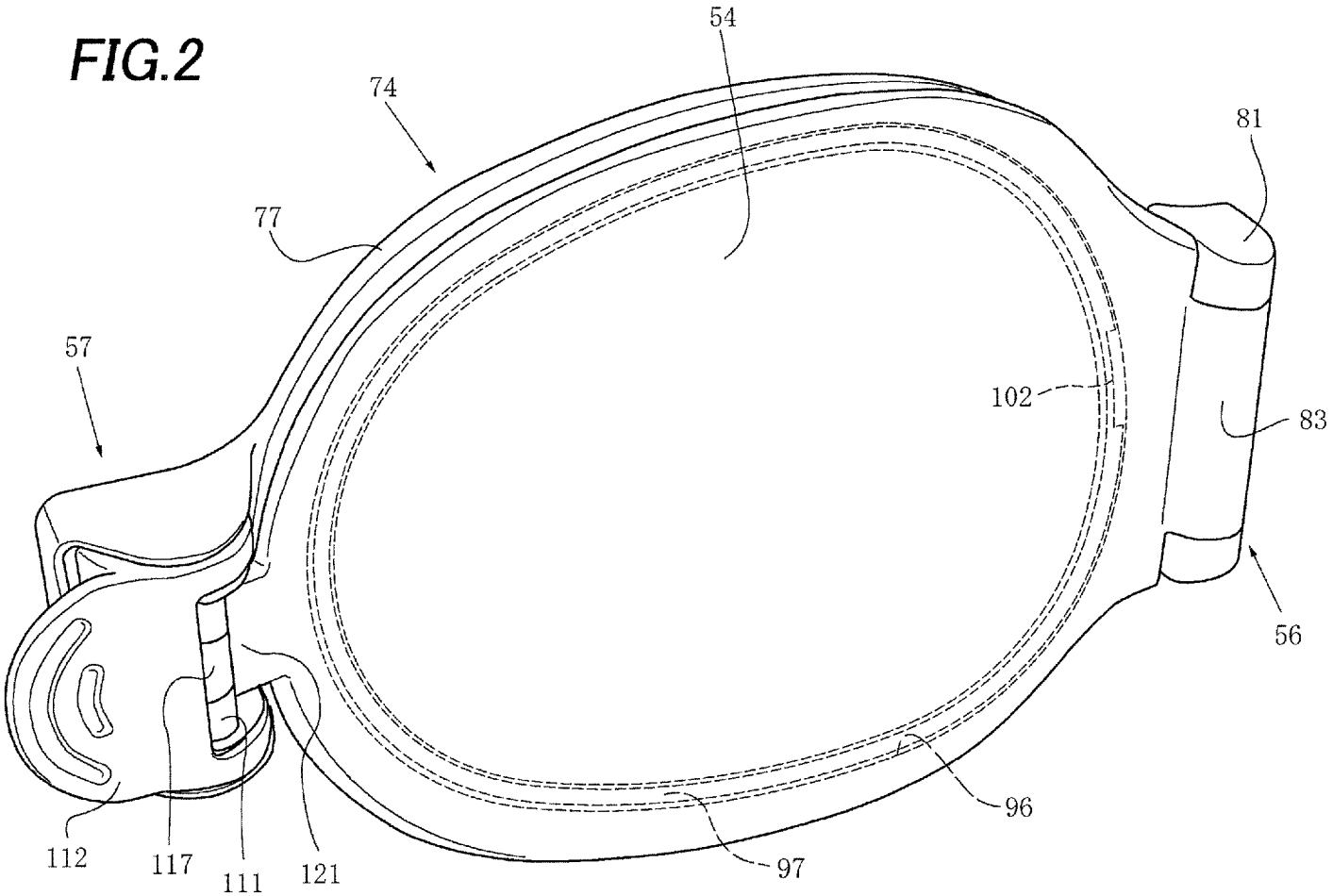
FIG. 2 is a perspective view of a left side service door mechanism of the incubator illustrated in FIG. 1.

The head side peripheral wall section 21 may be substantially the same size and substantially the same shape as the leg side peripheral wall section 22 illustrated in FIG. 1 and FIG. 2. The both peripheral wall sections 21 and 22 are disposed in a state substantially facing each other in FIG. 1 so as to have left-right symmetry. A hand insertion opening 44 is formed in a center portion of both the head side peripheral wall section 21 and the leg side peripheral wall section 22. An iris port forming member (in other words, an iris diaphragm) 43 including an aperture face made of cloth or the like is attached to each of the hand insertion openings 44. Notches (not illustrated in the drawings) are formed in a front portion and a rear portion of both the head side peripheral wall section 21 and the leg side peripheral wall section 22. Grommet members 45 are attached to the respective notches. Engagement portions of a front and rear pair of latch mechanisms 46 are respectively arranged by integral molding or the like in the vicinity of an upper end of both the head side peripheral wall section 21 and the leg side peripheral wall section 22. Latch bearing portions 51, serving as engagement portions of first latch mechanisms 47, are arranged by integral molding or the like in the vicinity of respective upper ends at a rear end of the head side peripheral wall section 21 and at a front end of the leg side peripheral wall section 22. An opening (not illustrated in the drawings) for attaching auxiliary equipment such as an oxygen sensor is formed in the vicinity of the rear end and the vicinity of the upper end of the head side peripheral wall section 21.

The front side peripheral wall section 23 illustrated in FIG. 1 may be substantially the same size and substantially the same shape as the rear side peripheral wall section 24. The both peripheral wall sections 23 and 24 are disposed in a state substantially facing each other in FIG. 1 so as to have left-right symmetry. A left side service port 52 and a right side service port 53 are respectively arranged at a left side portion and a right side portion at both the front side peripheral wall section 23 and the rear side peripheral wall section 24. A left side service door 54 and a right side service door 55, which are respectively capable of opening and closing the left side service port 52 and the right side service port 53 and may be substantially transparent, are respectively installed at the left side portion and the right side portion at both the front side peripheral wall section 23 and the rear side peripheral wall section 24. Note that the reference numerals 56 indicate respective swing support shaft mechanisms of the left side and right side service doors 54, and 55. The reference numerals 57 indicate respective latch mechanisms of the left side and right side service doors 54, and 55.

As illustrated in FIG. 1, a left side hinge 63 and a right side hinge 64 are installed, so as to be capable of swinging outward and back inward about swing shafts (not illustrated in the drawings), at both left and right sides in the vicinity of an upper end of both a front side section 61 and a rear side section 62 of the incubator base 12. A left and right pair of second latch mechanisms 65 are respectively installed on both the front side peripheral wall section 23 and the rear side peripheral wall section 24 such that the second latch mechanisms 65 respectively engage with a lower end on both the front side and rear side of the top hood 26 when the peripheral wall sections 23 and 24 are in a closed state. Latch levers 66, each serving as an engaging portion of the first latch mechanisms 47, are respectively installed in the vicinity of a left side end of an upper side end of the front side peripheral wall section 23, and the vicinity of a right side end of an upper side end of the rear side peripheral wall section 24. When opening the front side and rear side peripheral wall sections 23, 24, the front side and rear side peripheral wall sections 23, 24 are opened after unlatching the respective latch levers 66 from the latch bearing portions 51 by a shift-out operation of the latch levers 66.

As illustrated in FIG. 1, the top hood 26 may be foamed in a substantially truncated rectangular pyramid shape or the like, and a lower face thereof may be a hollow body opens over the entire area. Note that a peripheral frame section 71, which is substantially an angular tube shape with both an upper face and a lower face open over the entire area in plan view, is configured by the head side peripheral wall section 21, the leg side peripheral wall section 22, the front side peripheral wall section 23, and the rear side peripheral wall section 24. The enclosure 13 is configured by the peripheral frame section 71, and the top hood 26 that is capable of selectively covering the upper face opening of the peripheral frame section 71. Engaging portions 78 of the front and rear pair of latch mechanisms 46 are respectively installed at a front portion and a rear portion of both the head side end and the leg side end of the top hood 26.

A left side lower end and a right side lower end of the top hood 26 are respectively attached and fixed to the head side peripheral wall section 21 and the leg side peripheral wall section 22 by the respective front and rear pairs of latch mechanisms 46. A head side wall section 72 and a leg side wall section 73 of the top hood 26 are thereby respectively coupled to the head side peripheral wall section 21 and the leg side peripheral wall section 22 of the peripheral frame section 71. Respective lower ends of the head side wall section 72 and leg side wall section 73 of the top hood 26 may be attached and fixed to the respective upper ends of the head side and leg side peripheral wall sections 21, 22 in a state capable of being detached therefrom by the respective front and rear pairs of latch mechanisms 46.

The second latch mechanisms 65 are respectively installed on both the front side peripheral wall section 23 and the rear side peripheral wall section 24 in order to reliably retain both the front side peripheral wall section 23 and the rear side peripheral wall section 24 in the swung-back position illustrated in FIG. 1. When the second latch mechanisms 65 have been placed in a state other than a substantially upright state as illustrated in FIG. 1 (such as a substantially hanging state or a substantially sideways state), the respective second latch mechanisms 65 can be placed in the substantially upright state by swinging the respective front side and rear side peripheral wall sections 23, 24 from an open position to a closed position, and then swing-operating the respective second latch mechanisms 65. The front side and rear side peripheral wall sections 23, 24 can be reliably and simply locked in the closed position by this swinging operation. This locking can be released by performing the reverse operation to that described above. Note that when it is desirable to open the front side and rear side peripheral wall sections 23, 24, the respective front side and rear side peripheral wall sections 23, 24 may be swung out after releasing the locking as described above, then removing the latch levers 66 from the latch bearing portions 51.

2. Explanation of Service Door Mechanism

As illustrated in FIG. 1, a left side service door mechanism 74 and a right side service door mechanism 75 are respectively installed on both the front side peripheral wall section 23 and the rear side peripheral wall section 24. Note that the right side service door mechanism 75 and the left side service door mechanism 74 of the front side peripheral wall section 23 have substantially left-right symmetry. The left side service door mechanism and the right side service door mechanism of the rear side peripheral wall section 24 also have substantially left-right symmetry. The left side service door mechanism of the rear side peripheral wall section 24 and the right side service door mechanism 75 of the front side peripheral wall section 23 have substantially front-rear symmetry. The right side service door mechanism of the rear side peripheral wall section 24 and the left side service door mechanism 74 of the front side peripheral wall section 23 also have substantially front-rear symmetry. Thus, detailed explanation follows regarding the left side service door mechanism 74 of the front side peripheral wall section 23, and detailed explanation regarding the right side service door mechanism 75 of the front side peripheral wall section 23, as well as both left and right side service door mechanisms of the rear side peripheral wall section 24, is omitted.

Figure 3:
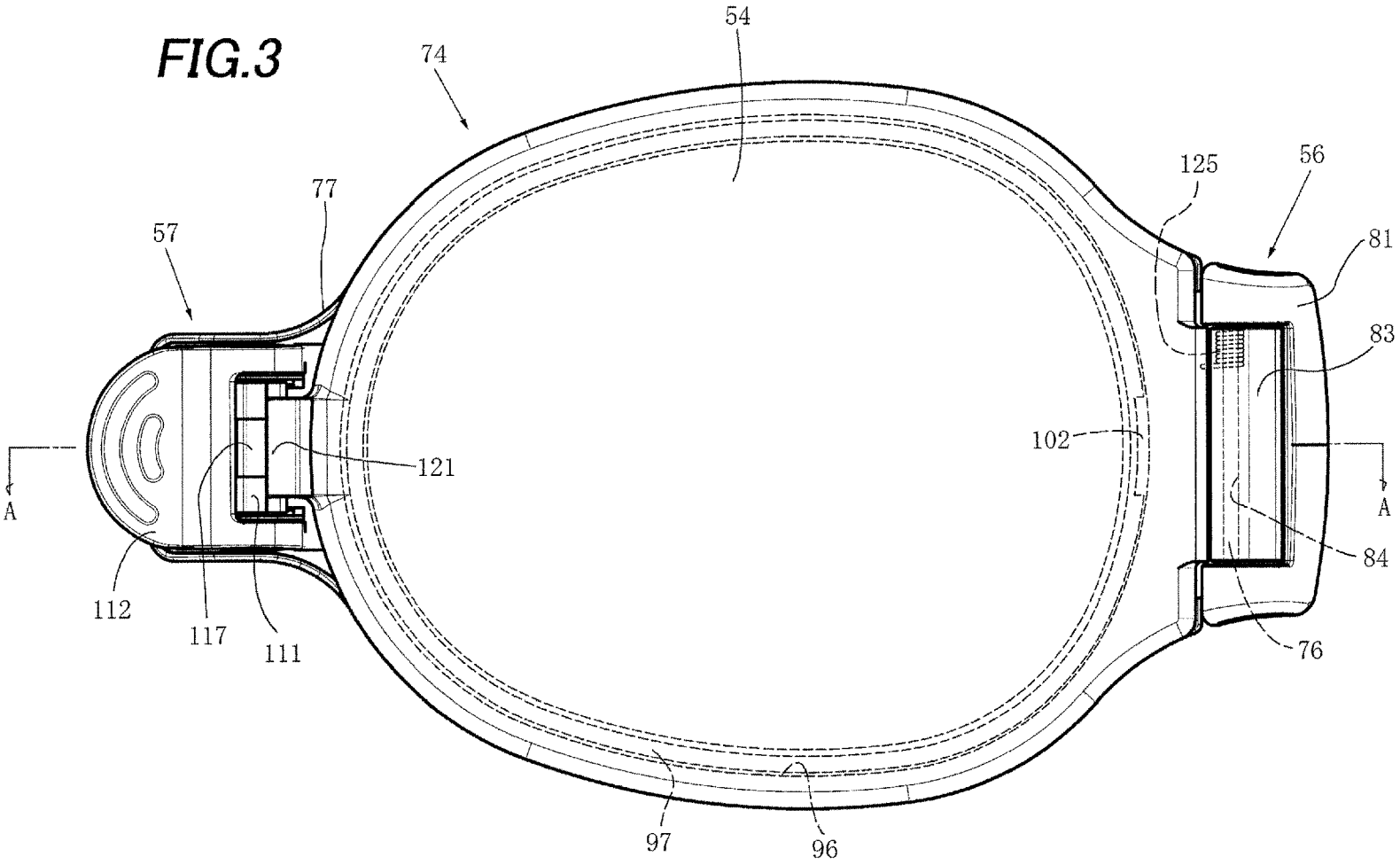
FIG. 3 is a face-on view of the service door mechanism illustrated in FIG. 2.
Figure 4:
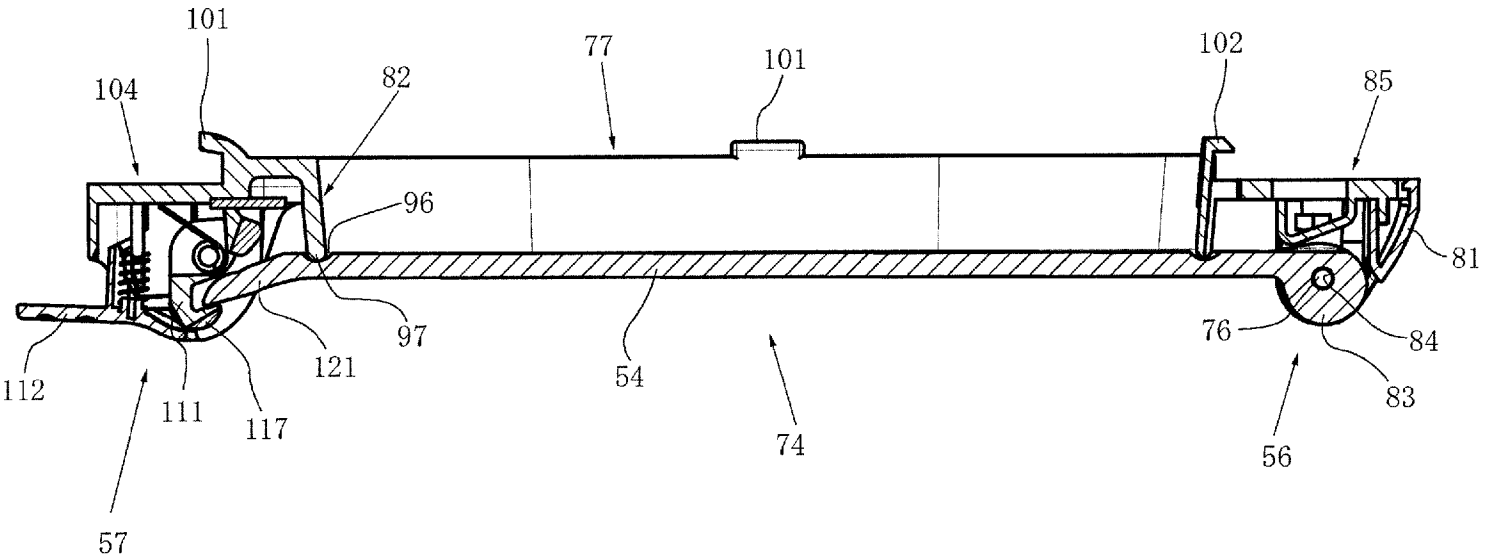
FIG. 4 is a cross-section taken along line A-A in FIG. 3.

As illustrated in FIG. 2 to FIG. 4, etc. the left side service door mechanism 74 includes the left side service door 54, the swing support shaft mechanism 56 including a swing support shaft 76 that supports the left side service door 54 so as to allow swinging to and fro, a base frame 77 to which the swing support shaft 76 is attached, the latch mechanism 57 installed at a right side end (in other words, one side end in substantially the horizontal direction) of the base frame 77, and a substantially reverse C-shaped cover member 81 that partially covers a left side end (in other words, another side end in substantially the horizontal direction) of the base frame 77. A left side end of the left side service door 54 is indirectly axially supported by the base frame 77 so as to be capable of swinging about the swing support shaft 76. Both ends of the swing support shaft 76 are supported by respective shaft bearing portions projecting out at the left side end of the base frame 77. A left side end 83, this being one end from out of both left and right side ends of the left side service door 54, is configured round, such that its external appearance has a substantially log shape. A through-hole 84 for configuring an axially supported portion is formed in the left side end 83. The swing support shaft 76 is inserted through the through-hole 84.

Figure 5A:
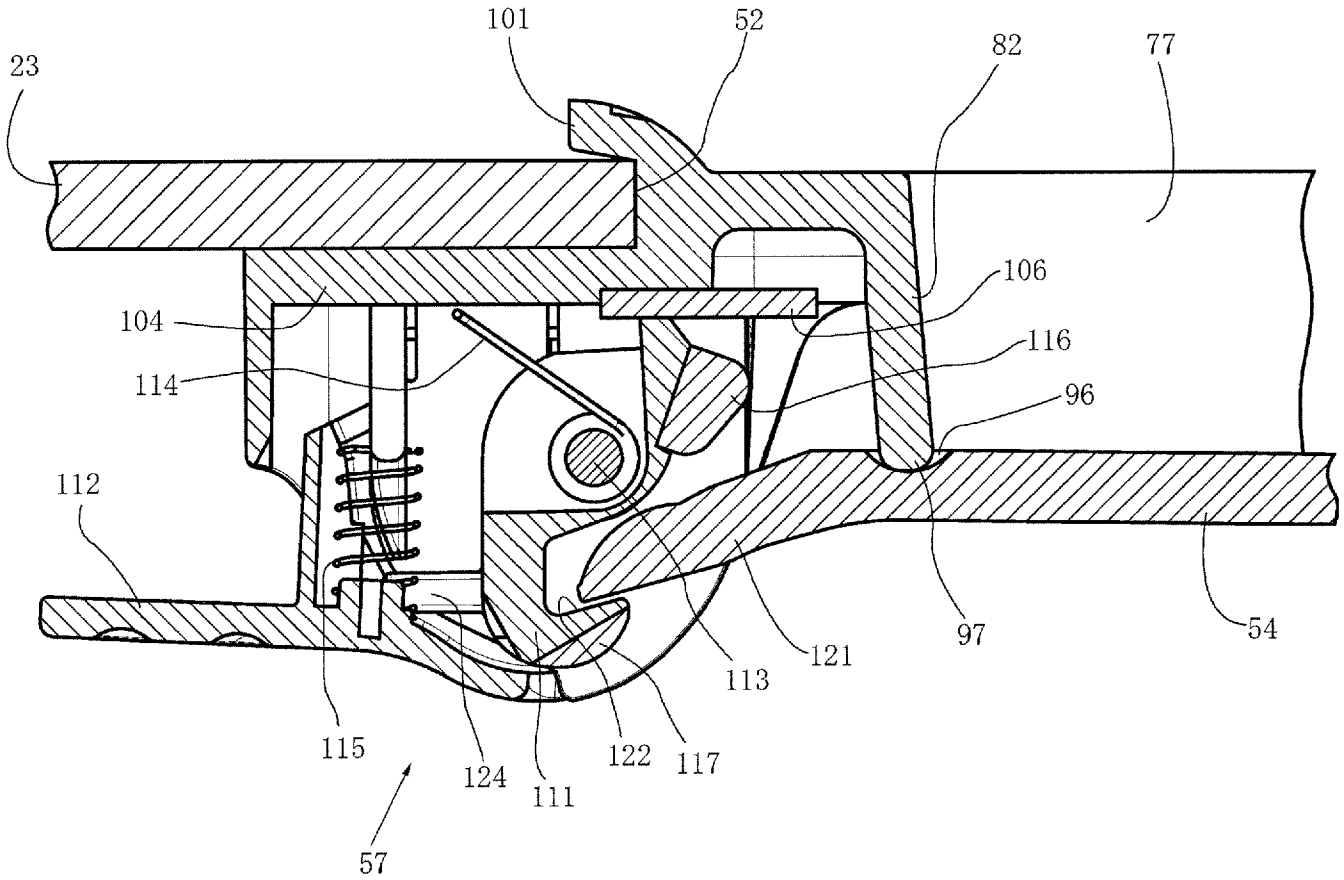
FIG. 5A is an enlarged horizontal cross-section of the latch mechanism illustrated in FIG. 4.
Figure 6:
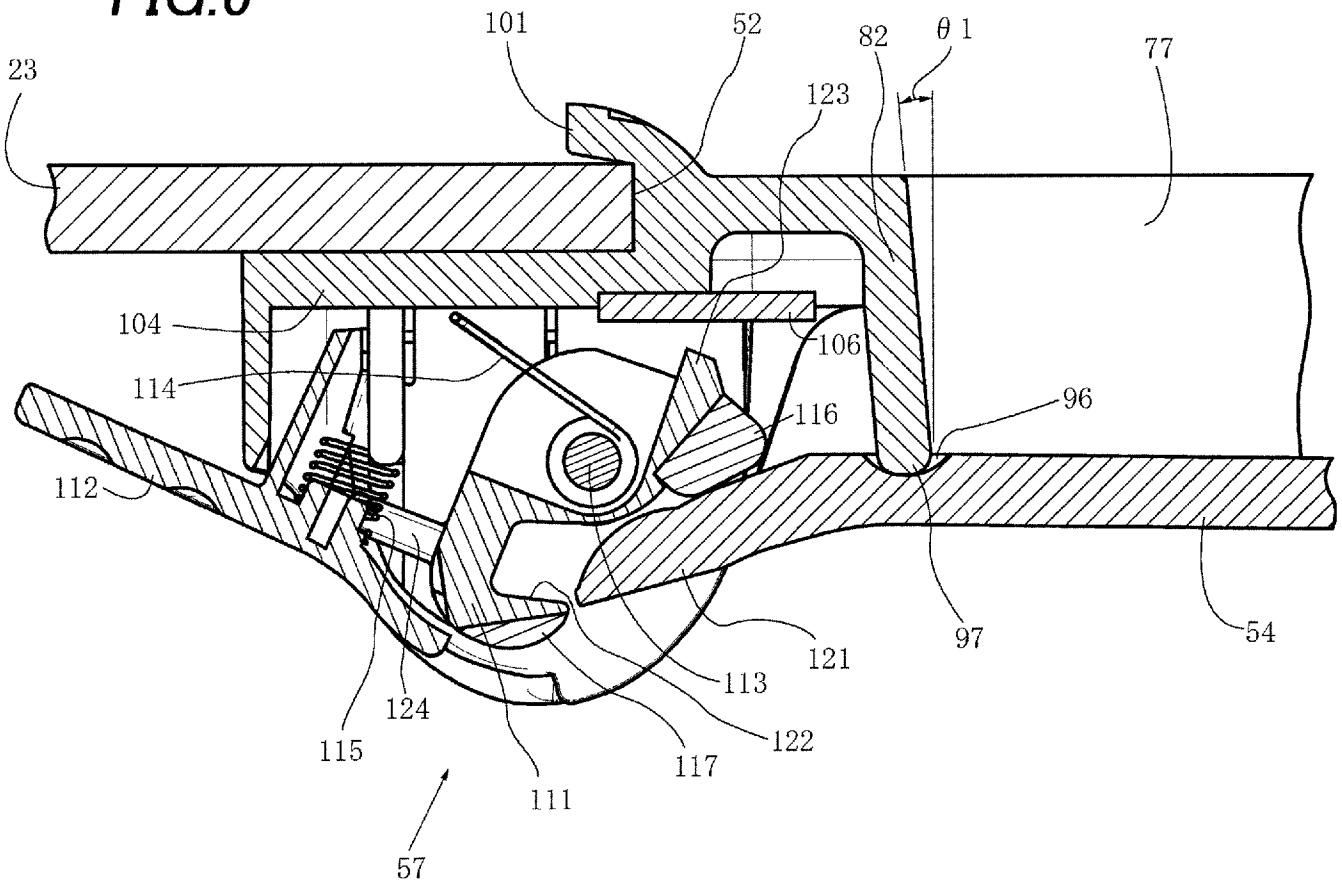
FIG. 6 is a horizontal cross-section similar to FIG. 5A in the vicinity of the latch mechanism illustrated in FIG. 4, in a state in which a latch lever has been swung out to a latch release position.
Figure 8:
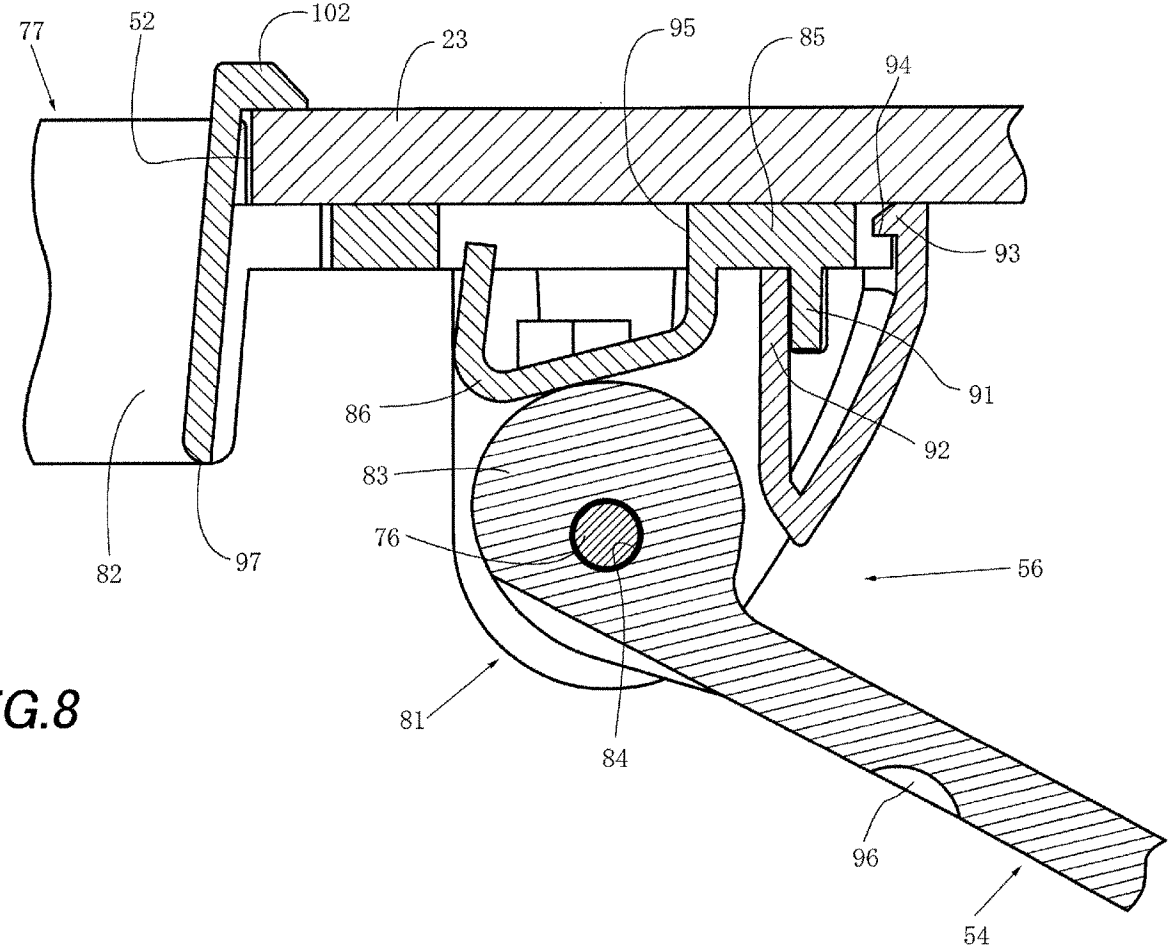
FIG. 8 is a partial horizontal cross-section in the vicinity of a swing support mechanism of a service door of the incubator illustrated in FIG. 1, in a state in which the service door is open.

An inner face of a substantially ring-shaped and protrusion shaped outer peripheral portion 82 of the base frame 77 illustrated in FIG. 4, FIG. 5A, FIG. 8, etc. slopes slightly so as to taper on progression from the infant accommodation space 25 side of the incubator 11 toward an exterior. As illustrated in FIG. 6, an angle of slope θ1 of the inner face of the outer peripheral portion 82 is approximately 5° in the illustrated example. From a practical perspective, the angle of slope θ1 is preferably from 2° to 8°, is more preferably from 3° to 7°, and is most preferably from 4° to 6°. By being configured as described above, even when liquid droplets such as water droplets have been deposited at an inner face in the vicinity of a lower side of the outer peripheral portion 82, such liquid droplets mainly flow toward the infant accommodation space 25, and there is little concern of the liquid droplets flowing out into the exterior. Note that the entire service door 54 and base frame 77 illustrated in FIG. 4, etc. may each be configured by a synthetic resin such as a substantially transparent or semi-transparent ABS resin, polycarbonate resin, acrylic resin, or the like, or another material. In particular, ABS resin, from which dirt due to the liquid droplets or the like can be easily removed, which is easy to clean, and which is one of thermoplastic resin, is preferably employed for the base frame 77.

As illustrated in FIG. 4, FIG. 8, etc. the base frame 77 includes a left side support plate 85 that extends substantially integrally along an outer face of the front side peripheral wall section 23 from the outer peripheral portion 82 toward the left side (in other words, outward). The left side support plate 85 respectively includes a brake portion 86 and a support portion 91. The brake portion 86 has a substantially U-shaped cross-section integrally extending still further outward from the outer face of the front side peripheral wall section 23, and the support portion 91 integrally extends still further outward from the outer face of the front side peripheral wall section 23. Note that the swing support shaft 76 is attached to and supported by the left side support plate 85 through an upper and lower pair of attachment portions (not illustrated in the drawings) respectively installed to the left side support plate 85 so as to be disposed inside the cover member 81. The cover member 81 is attached and fixed to the left side support plate 85 by an attachment portion 92, an engaging tab 93, and the like. An insertion slit 94 for inserting (in other words, engaging) the engaging tab 93 is arranged in the left side support plate 85. The support portion 91 is configured so as to be abutted by the attachment portion 92. An opening 95 is also formed in the left side support plate 85 so as to enable entry and exit of a leading end of the brake portion 86.

When the left side service door 54 is in a closed state as illustrated in FIG. 4, a ring-shaped insertion (in other words, engaging) groove 96, which may have substantially the same shape as a ring-shaped outer end of the outer peripheral portion 82, is formed in an inner face of the service door 54 as illustrated in FIG. 3, FIG. 4, etc. As illustrated in FIG. 4, the service door 54 is configured such that a leading end 97 of the outer peripheral portion 82 of the base frame 77 can engage with the engaging groove 96 when in the closed state. This enables airtightness to be reliably maintained between the front side peripheral wall section 23 and the service door mechanism 74. Note that the outer peripheral portion 82 (in other words, the leading end 97 of the protrusion shaped outer peripheral portion 82) may have an oval shape that tapers on progression from a right side toward a left side as viewed face-on in a substantially upright state illustrated in FIG. 3.

Figure 5B:
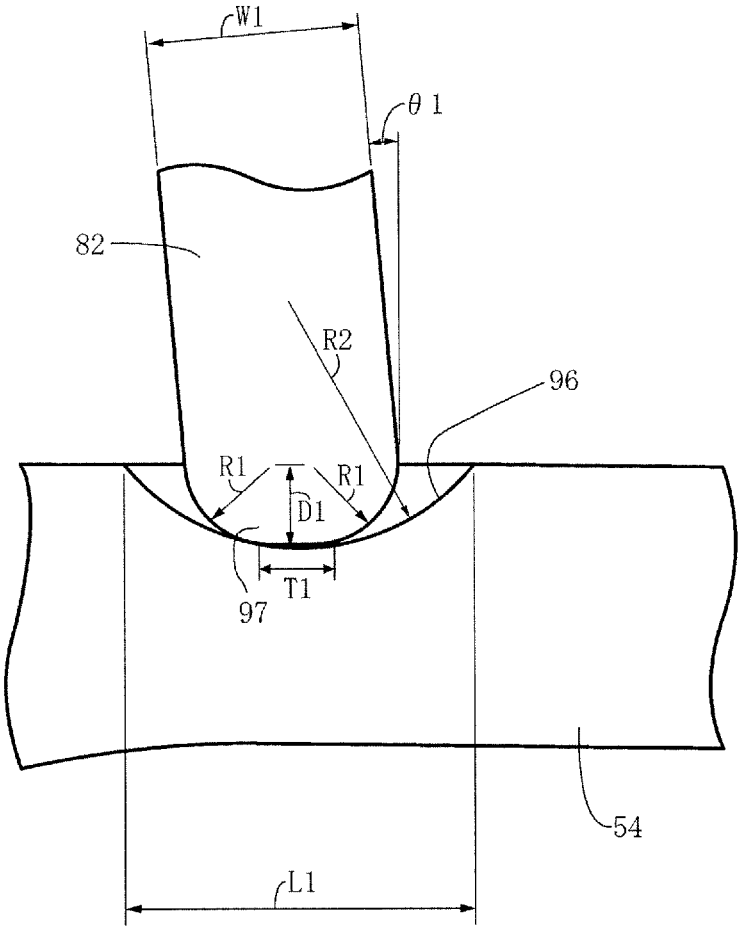
FIG. 5B is an enlarged horizontal cross-section of a portion in the vicinity of the latch mechanism illustrated in FIG. 5A, with the hatching omitted.

As illustrated in FIG. 5A and FIG. 5B, a thickness W1 of the ring-shaped outer peripheral portion 82 is approximately 3.8 mm. A width T1 of a flat central portion of the leading end 97 is approximately 0.8 mm. Both left and right sides of the flat central portion of the leading end 97 are each configured as a circular arc face that has a radius R1 of approximately 1.5 mm. A width L1 of the engaging groove 96 of the left side service door 54 is approximately 6.3 mm. A depth D1 of the engaging groove 96 is approximately 1.5 mm. A width direction cross-section profile orthogonal to an extending direction of the engaging groove 96 has a circular arc shape. A circular arc-shaped sloped face with a radius R2 of approximately 4 mm is configured in the width direction orthogonal to the extending direction of the engaging groove 96. A ratio of the thickness W1 of the ring-shaped outer peripheral portion 82 to the width L1 of the engaging groove 96 (namely, W1/L1) is approximately 0.6.

From a practical perspective, the width W1 of the ring-shaped outer peripheral portion 82 illustrated in FIG. 5A and FIG. 5B is preferably from 1.5 mm to 6.1 mm, is more preferably from 2.3 mm to 5.3 mm, and is most preferably from 3 mm to 4.6 mm. From a practical perspective, the width T1 of the flat central portion of the leading end 97 is preferably from 0.32 mm to 1.28 mm, is more preferably from 0.48 mm to 1.12 mm, and is most preferably from 0.64 mm to 0.96 mm. From a practical perspective, the radius R1 of the circular arc face of both the left and right sides of the flat central portion of the leading end 97, and the depth D1 of the engaging groove 96, are each preferably from 0.6 mm to 2.4 mm, are each more preferably from 0.9 mm to 2.1 mm, and are each most preferably from 1.2 mm to 1.8 mm. From a practical perspective, the width L1 of the engaging groove 96 of the left side service door 54 is preferably from 2.5 mm to 10 mm, is more preferably from 3.8 mm to 8.8 mm, and is most preferably from 5 mm to 7.6 mm. From a practical perspective, the radius R2 of the circular arc-shaped sloped face in the width direction orthogonal to the extending direction of the engaging groove 96 is preferably from 1.6 mm to 6.4 mm, is more preferably from 2.4 mm to 5.6 mm, and is most preferably from 3.2 mm to 4.8 mm. From a practical perspective, the ratio of the thickness W1 of the ring-shaped outer peripheral portion 82 to the width L1 of the engaging groove 96 (namely, W1/L1) is preferably from 0.24:1 to 0.96:1, is more preferably from 0.36:1 to 0.84:1, and is most preferably from 0.4:1 to 0.72:1.

As illustrated in FIG. 4, FIG. 5A, etc., first engaging tabs 101 for engaging with the front side peripheral wall section 23 respectively project out in the vicinity of an upper side end, in the vicinity of a lower side end, and in the vicinity of a right side end of the base frame 77 of the left side service door mechanism 74. A second engaging tab 102, also for engaging with the front side peripheral wall section 23, projects out in the vicinity of the left side end of the base frame 77. The second engaging tab 102 is configured comparatively thin and readily undergoes elastic deformation, so that the service door mechanism 74 can be comparatively easily detached from the front side peripheral wall section 23. Specifically, the service door mechanism 74 can be taken off the front side peripheral wall section 23 by causing the second engaging tab 102 arranged at the left side end of the base frame 77 to undergo elastic deformation toward the center of the base frame 77, then pulling out the second engaging tab 102 further forward than the front side peripheral wall section 23, and then pulling out the service door mechanism 74 illustrated in FIG. 1 toward the right side in FIG. 1. Since the outer peripheral portion 82 has an oval shape as previously described, the pulling-out operation of the service door mechanism 74 toward the right side in FIG. 1 as described above can be comparatively simply and reliably performed.

Figure 7:
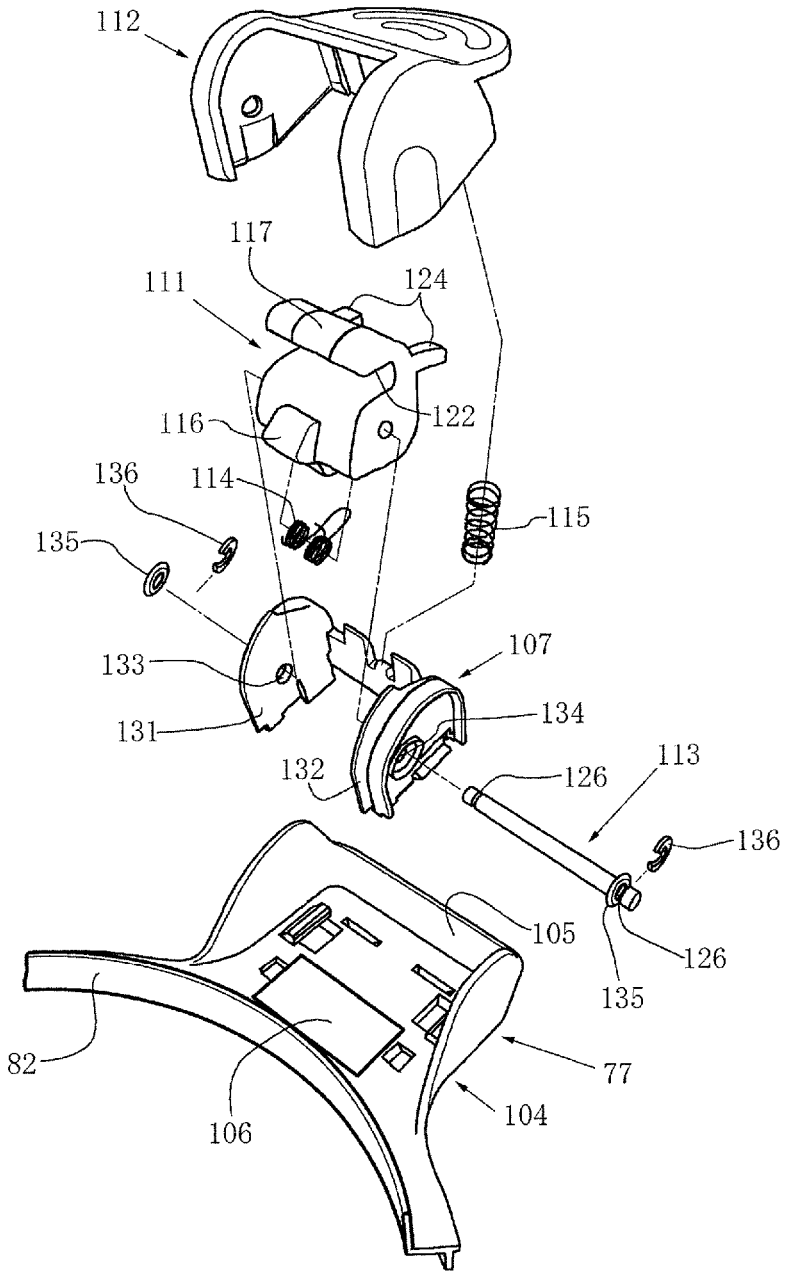
FIG. 7 is an exploded perspective view in the vicinity of the latch mechanism illustrated in FIG. 5A.

As illustrated in FIG. 4, FIG. 5A, FIG. 7, etc., the base frame 77 includes a right side support plate 104 integrally extending from the outer peripheral portion 82 of the base frame 77 along the outer face of the front side peripheral wall section 23 toward the right side (in other words, toward the right side service door 55). A reverse C-shaped projection wall 105 that extends still further toward the outside from the outer face of the front side peripheral wall section 23 is integrally formed to the right side support plate 104. An elastic plate 106 formed of a cushioning material such as silicone rubber is attached and fixed to a front side face of the right side support plate 104. A support member 107 is also attached and fixed to the front side face of the right side support plate 104 so as to be adjacent to the elastic plate 106. A latch lever 111 and an operating lever 112 are respectively attached to the support member 107 so as to be capable of swinging about a support shaft 113. A torsion coil spring 114, which biases the swing of the latch lever 111 in the counterclockwise direction in FIG. 5A with the support shaft 113 as a pivot point, is attached to the support shaft 113. A compression coil spring 115 is fitted interposed between the support member 107 and the operating lever 112. Thus, the swing of the operating lever 112 is biased in the counterclockwise direction in FIG. 5A by the compression coil spring 115 with the support shaft 113 as a pivot point.

As illustrated in FIG. 5A, FIG. 6 and FIG. 7, an engaging recess 122 for engaging a leading end 121 of the left side service door 54 is formed at the latch lever 111. An elastic block 117 is installed on the latch lever 111 so as to be positioned at a leading end of the front side of the latch lever 111. A stopper 123 that is capable of abutting the elastic plate 106 is formed at an end at the support plate 104 side of the latch lever 111. The elastic block 117, which is abutted by the leading end 121 of the left side service door 54 when the service door 54 is closed, is installed at a front end of the latch lever 111. The latch lever 111 thereby swings in the clockwise direction in FIG. 5A with the support shaft 113 as a pivot point, such that the leading end 121 abuts the elastic block 117. This swinging of the latch lever 111 in the clockwise direction in FIG. 5A enables the leading end 121 of the service door 54 to engage with the engaging recess 122.

As illustrated in FIG. 5A, FIG. 6, and FIG. 7, the operating lever 112 is configured so as to be capable of swinging with the support shaft 113 as a swing pivot point, and is biased in the counterclockwise direction with the support shaft 113 as a pivot point by the compression coil spring 115. Thus, when the operating lever 112 is swung out in the clockwise direction with the support shaft 113 as a pivot center from the state illustrated in FIG. 5A, the operating lever 112 presses an upper and lower pair of pressed portions 124 of the latch lever 111. The latch lever 111 accordingly swings out from the state illustrated in FIG. 5A to the state illustrated in FIG. 6 with the support shaft 113 as a swing pivot point. An elastic block 116 of the latch lever 111 presses an inner face of the leading end 121 of the left side service door 54 when this occurs. Thus, the left side service door 54 swings out slightly with the swing support shaft 76 as a swing pivot point, and then swings out to a substantially fully open state as illustrated in FIG. 8 due to biasing force of a coil spring 125 (see FIG. 3) attached to the swing support shaft 76.

As illustrated in FIG. 7, ring-shaped engaging grooves 126 are respectively formed in the vicinity of both ends of the support shaft 113. Both ends of the support shaft 113 are respectively fitted into through-holes 133, 134 formed in both walls 131, 132 of the support member 107. A pair of O rings 135 are respectively fitted onto the vicinity of both ends of the support shaft 113, and a pair of C rings 136 are also respectively fitted thereon so as to be adjacent to the pair of O rings 135. When this is performed, the pair of C rings 136 are respectively engaged with the pair of engaging grooves 126, and the pair of O rings 135 are respectively installed between the pair of walls 131, 132 and the pair of engaging grooves 126. Note that the pair of O rings 135 have a function to prevent the support shaft 113 from rattling against the support member 107. The pair of C rings 136 have a function to stop the support shaft 113 from coming out of the support member 107.

An exemplary embodiment of the present invention has been explained in detail above; however, the present invention is not limited to this exemplary embodiment, and various modifications and revisions are possible based on the scope of the invention as recited in the claims.

For example, the present invention is applied to a closed incubator in the above-described exemplary embodiment. However, the present invention is not only applicable to a closed incubator, and may also be applied to other types of incubator, such as a closed incubator that may be employed as an open incubator.

Moreover, in the above-described exemplary embodiment, the insertion (in other words, engaging) groove 96 is formed in a substantially complete ring shape at the inner face of the service door 54, and the leading end 97 of the outer peripheral portion 82 is also formed in a substantially complete ring shape around the engaging groove 96. However, in some cases, the engaging groove 96 may include some intermittent portions without being a substantially complete ring shape, and the leading end 97 may also include some cutout portions so as to correspond to the above intermittent portions or the like.

What is claimed is:

1. An incubator comprising:

a service port provided at a peripheral wall section of an infant accommodation space;

a service door capable of opening and closing the service port by swinging to and fro, a substantially ring-shaped insertion groove being formed at an inner face of the service door so as to run along an outer periphery of the inner face;

a base frame attached to the peripheral wall section and retaining the service door so as to be capable of swinging to and fro, a substantially ring-shaped outer peripheral portion being formed at the base frame; and a latch mechanism retaining the service door in a closed position, wherein the incubator is configured such that, when the service door is retained in the closed position, a leading end of the substantially ring-shaped outer peripheral portion of the base frame is inserted into the substantially ring-shaped insertion groove of the service door.

2. The incubator of claim 1, wherein:

a thickness (W1) of the substantially ring-shaped outer peripheral portion of the base frame is from 1.5 mm to 6.1 mm;

a width (T1) of a flat central portion of the leading end of the substantially ring-shaped outer peripheral portion is from 0.32 mm to 1.28 mm;

a radius (R1) of a circular arc face on both left and right sides of the flat central portion of the leading end is from 0.6 mm to 2.4 mm;

a width (L1) of the substantially ring-shaped insertion groove of the service door is from 2.5 mm to 10 mm;

a radius (R2) of a circular arc-shaped sloping face in a width direction of the substantially ring-shaped insertion groove is from 1.6 mm to 6.4 mm; and a ratio (W1/L1) of the thickness (W1) of the substantially ring-shaped outer peripheral portion to the width (L1) of the substantially ring-shaped insertion groove is from 0.24:1 to 0.96:1.

3. The incubator of claim 1, wherein:

a thickness (W1) of the substantially ring-shaped outer peripheral portion of the base frame is from 2.3 mm to 5.3 mm;

a width (T1) of a flat central portion of the leading end of the substantially ring-shaped outer peripheral portion is from 0.48 mm to 1.12 mm;

a radius (R1) of a circular arc face on both left and right sides of the flat central portion of the leading end is from 0.9 mm to 2.1 mm;

a width (L1) of the substantially ring-shaped insertion groove of the service door is from 3.8 mm to 8.8 mm;

a radius (R2) of a circular arc-shaped sloping face in a width direction of the substantially ring-shaped insertion groove is from 2.4 mm to 5.6 mm; and a ratio (W1/L1) of the thickness (W1) of the substantially ring-shaped outer peripheral portion to the width (L1) of the substantially ring-shaped insertion groove is from 0.36:1 to 0.84:1.

4. The incubator of claim 1, wherein:

a thickness (W1) of the substantially ring-shaped outer peripheral portion of the base frame is from 3 mm to 4.6 mm;

a width (T1) of a flat central portion of the leading end of the substantially ring-shaped outer peripheral portion is from 0.64 mm to 0.96 mm;

a radius (R1) of a circular arc face on both left and right sides of the flat central portion of the leading end is from 1.2 mm to 1.8 mm;

a width (L1) of the substantially ring-shaped insertion groove of the service door is from 5 mm to 7.6 mm;

a radius (R2) of a circular arc-shaped sloping face in a width direction of the substantially ring-shaped insertion groove is from 3.2 mm to 4.8 mm; and a ratio (W1/L1) of the thickness (W1) of the substantially ring-shaped outer peripheral portion to the width (L1) of the substantially ring-shaped insertion groove is from 0.48:1 to 0.72:1.

5. The incubator of claim 1, wherein:

an inner face of the substantially ring-shaped outer peripheral portion of the base frame slopes with a taper such that a region inside the ring-shaped outer peripheral portion decreases on progression from an infant accommodation space side toward an exterior.

6. The incubator of claim 5, wherein an angle of slope (θ1) of the taper is from 2° to 8°.

7. The incubator of claim 5, wherein an angle of slope (θ1) of the taper is from 3° to 7°.

8. The incubator of claim 5, wherein an angle of slope (θ1) of the taper is from 4° to 6°.

9. The incubator of claim 1, wherein the base frame is configured by a plastic material.

10. The incubator of claim 1, wherein the incubator is a closed incubator.

* * * * *